United States Patent [19]

Dounchis et al.

[11] 3,975,153

[45] Aug. 17, 1976

[54] ACTIVATION OF PEROXYGEN BLEACHES USING ISOPHORONE ENOL ACETATES AND ISOPHORONE OXIMINOACETATE

[75] Inventors: Harry Dounchis, Lawrenceville; Fui-Tseng H. Lee, Princeton, both of N.J.

[73] Assignee: FMC Corporation, Philadelphia, Pa.

[22] Filed: Aug. 25, 1975

[21] Appl. No.: 607,191

[52] U.S. Cl. ..... 8/111; 252/95; 252/98; 252/102; 252/186

[51] Int. Cl.[2] ..... D06L 3/02; C11D 7/54; C11D 9/42

[58] Field of Search ..... 8/111; 252/98, 102, 252/95

[56] References Cited

UNITED STATES PATENTS

| | | | |
|---|---|---|---|
| 3,153,565 | 10/1964 | Dithmar et al. | 252/98 |
| 3,163,606 | 12/1964 | Viveen et al. | 252/95 |
| 3,779,931 | 12/1973 | Fries et al. | 8/111 |
| 3,816,319 | 6/1974 | Sarot et al. | 252/95 |

*Primary Examiner*—Donald Levy
*Assistant Examiner*—Maria S. Tungol

[57] ABSTRACT

Peroxygen chemicals are activated, in laundering operations conducted below 80°C, by using as activators certain isophorone derivatives, to wit, the isophorone enol acetates and isophorone oximinoacetate.

2 Claims, No Drawings

ACTIVATION OF PEROXYGEN BLEACHES USING ISOPHORONE ENOL ACETATES AND ISOPHORONE OXIMINOACETATE

BACKGROUND OF THE INVENTION

In most laundry operations in the United States, active chlorine compounds are used for bleaching. These are objectionable to many people because of their odor and their effect on many dyestuffs. Peroxygen compounds have been used in their place in some cases. In Europe, where laundering is generally carried out at 100°C, peroxygen compounds have replaced active chlorine compounds to a very large extent. However, at temperatures below 80°C, their activity falls off sharply; at the typical 50°–60°C laundering temperature used in the United States, their activity is very limited.

The bleaching activity of peroxygen compounds at 50°–60°C can be enhanced by the use of activators such as acetic anhydride, isopropenyl acetate and β-propiolactone, by the use of certain carboxylic acid esters (see U.S. Pat. No. 2,955,905 issued Oct. 11, 1960) and a variety of other materials. Unfortunately, the known activators all have various drawbacks. For large-scale commercial laundering operations, where important considerations are cost effectiveness on the one hand, and absence of odor, skin-irritation, toxicity and formation of objectionable by-products on the other, the known activators have not been sufficiently good to engender, on a large scale, the desirable switch from active chlorine to active oxygen. A rather good review of the problems is reported in a three-part article by A. H. Gilbert in *Detergent Age* in June (p. 18 ff), July (p. 30 ff) and August (p. 26 ff) 1967.

OBJECT OF THE INVENTION

The principal object of the present invention is the provision of active oxygen activators which have little odor, no skin-irritating properties or toxicity, and do not form objectionable by-products.

STATEMENT OF THE INVENTION

In accordance with the instant invention, we use as activators for peroxygen compounds in laundering operations at elevated temperatures below 80°C, generally of the order of 50°–60°C, certain isophorone derivatives, specifically the isophorone enol acetates, and isophorone oximinoacetate. The activator is used in amounts from about one-half mol of activator per mol of peroxygen compound to as much as is desired. Above equimolar proportions, improvement in activity falls off sharply so that about equimolar proportions represent an optimum concentration from a cost-effectiveness point of view.

DETAILED DESCRIPTION OF THE INVENTION

The isophorone derivatives which we employ as activators are known compounds. The isophorone enol acetates may be prepared, as described in British Pat. No. 1 226 730, published Mar. 31, 1971 and granted to R. J. Reynolds Tobacco Company, by the reaction of isophorone and isopropenyl acetate, to yield a mixture of isomers, all of which seem equally useful as activators for peroxygen compounds. The compounds are 3,3,5-trimethyl-1,3-cyclohexadien-1-ol acetate, 3,3,5-trimethyl-1,5-cyclohexadien-1-ol acetate, and 3-methylidene-5,5-dimethyl-1-cyclohexen-1-ol acetate. The oximinoacetate can be made, in accordance with Snider et al U.S. Pat. 2,424,860, July 29, 1947, by the following reaction:

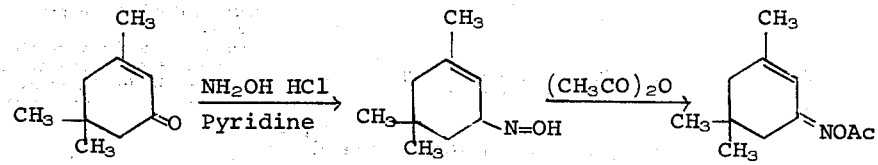

These compounds are liquids which, in the presence of active oxygen compounds in aqueous solution, yield organic peracids which seem to be the active bleaching agent at temperatures below 80°C. We have used the mixed isophorone enol acetates and isophorone oximinoacetate with hydrogen peroxide and with other peroxygen chemicals yielding the peroxide ion in the laundering bath, including peroxides of various metals, and with hydrogen peroxide addition compounds such as sodium perborate, sodium carbonate peroxide, and urea peroxide.

The activators of the present invention are useful with peroxygen compounds for ordinary bleaching of textiles at low tempratures, without added detergents, but their cost relative to the problems involved in ordinary bleaching operations makes this use economically unattractive. In domestic laundering operations, the use of separate bleach and activator additions is a marketing problem, since it is desirable to use the proper proportions of the two ingredients. This invention is, however, particularly useful in commercial laundering operations, where the addition of materials is carefully controlled and the large scale of operations makes the considerations of odor, toxicity and skin irritation most important.

No marked improvement in bleaching at 50°C is obtained below a molar ratio of 0.5 activator/1.0 peroxygen; the effectiveness increases rapidly up to a molar ratio of about 1.0/1.0; improvement is slight above this point, so that the optimum molar ratio is about 1.0/1.0.

SPECIFIC EXAMPLES OF THE INVENTION

The following specific examples of the invention are illustrative of the invention, although are not to be deemed limiting thereof. They illustrate the effectiveness of the activators.

Stain removal tests were carried out with tea-stained cotton swatches (4 × 5in.) using a Terg-O-Tometer made by the United States Testing Co., Inc., Hoboken, New Jersey. Procedure: In a Terg-O-Tometer vessel was placed 1 liter of 150 ppm hardness (as $CaCO_3$, 2/1 Ca/Mg ratio) water containing 0.15% of either a non-phosphate or phosphate-based laundry detergent. Where appropriate, sufficient sodium perborate or sodium carbonate peroxide (SCP) and activator were added to give the concentrations shown in the examples. Three stained and three unstained desized cotton swatches were added. The Terg-O-Tometer was then run at 100 cycles per minute for 30 minutes at the desired temperature. The swatches were removed from the wash solution, rinsed under cold tap water, then dried in a Kenmore Soft Heat electric clothes dryer for 20 minutes. Reflectance readings of the swatches were made before and after the Terg-O-Tometer test, using a Hunter Model D-40 Reflectometer. Reported percentages of tea stain removal were calculated according to the formula $$\frac{\Delta R}{40} \times 10$$

or $$\frac{\text{reflectance after bleaching} - \text{reflectance before bleaching}}{\text{reflectance before staining} - \text{reflectance stained}} \times 100$$

ΔR were obtained by averaging the readings obtained, using the blue and green filters of the reflectometer. Tea stains were used in these tests because they are considered to be the most difficult to remove of all stains.

Staining of Swatches: Four bags of Tetley tea (orange pekoe and pekoe, cut black) were added to 1 liter of boiling tap water (about 150 ppm hardness), and boiling was continued for 5 minutes. The tea bags were removed and thirty-two swatches (4 × 5inches) of desized Indianhead cotton muslin were added and kept in the boiling tea solution for another 5 minutes. The stained swatches were removed, wrung out by hand but not rinsed, and placed in a Kenmore household electric clothes dryer for 30 minutes. The dried stained swatches were then rinsed under a stream of cold tap water, smoothed out, and redried in the clothes dryer for another 20 minutes. Because of a slight aging effect on the stain, it has been found best to use swatches that are at least 2 days old but not more than 2 weeks old. Reflectances are measured just before use in a bleaching test.

EXAMPLE 1

The improvements in stain removal effectiveness of SCP on 100% cotton by the addition of, respectively, isophorone enol acetates and isophorone oximinoacetate are shown in the following table:

Conditions

| | |
|---|---|
| Type detergent | phosphorus Tide (P = 8.7%) |
| Active oxygen concentration | 66 ppm |
| Temperature | 50°C |
| Activator/SCP molar ratio | 1/1 |

Table

| Activator Added | % Tea Stain Removal Run A | Run B |
|---|---|---|
| Detergent + SCP alone | 49 | 40 |
| Detergent + SCP + isophorone enol acetates | 76 | — |
| Detergent + SCP + isophorone oximino-acetate | — | 71 |
| Detergent + SCP + isopropenyl acetate | — | 73 |

EXAMPLE 2

The effect of temperature on the activation of SCP by isophorone enol acetates and isophorone oximinoacetate was determined.

Conditions

| | |
|---|---|
| Type detergent | phosphorus Tide (P = 8.7%) |
| Active oxygen concentration | 66 ppm |
| Temperature | 22°C |
| Activator/SCP molar ratio | 1/1 |
| Fabric | cotton |

Table

| Activator Added | % Tea Stain Removal Run A | Run B |
|---|---|---|
| Detergent + SCP alone | 11 | 13 |
| Detergent + SCP + isophorone enol acetates | 23 | — |
| Detergent + SCP + isophorone oximino-acetate | — | 28 |
| Detergent + SCP + isopropenyl acetate | 45 | — |
| Detergent + SCP + triacetyl derivative of 2,4,6-trihydroxy-1,3,5-triazine | — | 43 |

EXAMPLE 3

Conditions

| | |
|---|---|
| Type detergent | phosphorus Tide (P = 8.7%) |
| Active oxygen concentration | 66 ppm |
| Temperature | 38°C |
| Activator/$H_2O_2$ molar ratio | 1/1 |

Table

| Activator Added | % Tea Stain Removal Cotton | 65/35 Dacron/Cotton |
|---|---|---|
| Detergent + active oxygen compound alone | 19 | 7 |
| Detergent + active oxygen compound + isophorone enol-acetates | 62 | 33 |

The examples have been limited to a single detergent composition and the single active oxygen compound so that comparisons can be made among the examples. However, the invention may be practiced with any commercial laundering agent, from ordinary soap to the very complicated built syndets so widely used in laundering. Any active oxygen compound which yields hydrogen peroxide in the laundering bath may be used. Moreover, the results with tea stains on cotton and polyester blends are indicative of the action on the less obstinate stains on other fabrics.

Obviously, the examples can be multiplied indefinitely without departing from the scope of the invention, which is defined in the claims.

We claim:

1. In the method of simultaneously laundering and bleaching fabrics in which the operation is carried out above ambient temperatures and below 80°C and the bleaching is effected with a peroxygen compound which yields peroxide ion in the laundering bath and an activator therefor which sharply increases the activity of said peroxygen compound at these temperatures, the improvement which consists in using as the activator at least one-half mol, per mol of active oxygen compound, of an isophorone derivative of the group consisting of isophorone enol acetates and isophorone oximinoacetate, the activators being characterized by low odor, toxicity and skin-irritating properties.

2. The method of claim 1, in which the molar ratio of activator to peroxygen compound is about 1/1.

* * * * *

UNITED STATES PATENT OFFICE
CERTIFICATE OF CORRECTION

PATENT NO. : 3,975,153
DATED : August 17, 1976
INVENTOR(S) : Harry Dounchis and Fui-Tseng H. Lee It is certified that error appears in the above-identified patent and that said Letters Patent are hereby corrected as shown below:

Column 3, line 12, "$\frac{\Delta R}{40} \times 10$" should read --$\frac{\Delta R}{40} \times 100$--.

Signed and Sealed this
Fourth Day of January 1977

[SEAL]

*Attest:*

RUTH C. MASON
*Attesting Officer*

C. MARSHALL DANN
*Commissioner of Patents and Trademarks*